United States Patent [19]

Geri

[11] Patent Number: 5,005,575

[45] Date of Patent: Apr. 9, 1991

[54] PLANTAR SUPPORT

[76] Inventor: Luciano Geri, Lungarna Simonelli No. 1, 56100 Pisa, Italy

[21] Appl. No.: 265,038

[22] Filed: Oct. 31, 1988

[30] Foreign Application Priority Data

Nov. 9, 1987 [IT] Italy ..... 9536 A/87

[51] Int. Cl.[5] ..... A61F 5/14; A61F 5/32

[52] U.S. Cl. ..... 128/581; 36/43; 128/594

[58] Field of Search ..... 128/594, 595, 581; 36/119, 43

[56] References Cited

U.S. PATENT DOCUMENTS

| | | | |
|---|---|---|---|
| 3,407,406 | 10/1968 | Werner et al. | 36/119 X |
| 3,469,576 | 9/1969 | Smith et al. | 128/594 X |
| 3,914,881 | 10/1975 | Striegel | 128/594 X |
| 3,990,457 | 11/1976 | Voorhees | 128/594 |
| 4,211,236 | 7/1980 | Krinsky | 128/594 |

*Primary Examiner*—Edgar S. Burr
*Assistant Examiner*—Moshe I. Cohen
*Attorney, Agent, or Firm*—McGlew & Tuttle

[57] ABSTRACT

This plantar support (1) must be arranged in the shoe in place of a rigid orthopedic sole; it contains cavities (3,5,7,9) with flexible and elastic walls which contain a granular material allowing adjustment of the bearing surface of the foot; it also has the possibility of metering the material in each cavity.

6 Claims, 2 Drawing Sheets

PLANTAR SUPPORT

DESCRIPTION

The invention relates to a corrective prosthesis as a replacement for a rigid orthopedic sole, which presents numerous possibilities of adjustment in terms of both shape and thickness and possibilities of progressive correction, this being completely impossible with traditional orthopedic soles which are rigid and the shape of which is almost incapable of adjustment.

This plantar support is more comfortable for walking than rigid orthopedic soles.

It fits both normal shoes, where correction and prevention are concerned, and special shoes, especially shoes for athletes.

Being inserted like a sole between the shoe and the foot, it can be used both for comfort and for correction wherever there is a static or dynamic imbalance. It has many functions, just like those of the fatty tissue which is under the sole of the human foot.

This plantar support which must be arranged in the shoe consists substantially of separate preformed cavities having flexible walls and filled with a formless material which allows adjustment of the bearing surface of the foot.

At least one of the walls of these cavities can be elastic and made of para-rubber or the like.

Although, in principle, a liquid can be used as the material for filling the cavities, it is preferable to use a granular material, preferably with spherical or equivalently shaped grains, the particular feature of which is that it matches the shape of the sole of the foot and thus has a stabilizing function, such as sand.

The walls of the cavities can be pierced by a needle suitable for filling them or emptying them, even partially.

The cavities can be included in a tubular sleeve made of leather, which forms the sole and which is applied to the shoe by means of fastening systems making it removable, such as, for example, VELCRO (trademark for a mating pile fastener). A sole can be produced in a single thickness or in two thicknesses which contribute to the formation of the cavities.

The invention will be understood better from the following description and drawing which illustrate a practical example. In the drawing.

Figure 3:
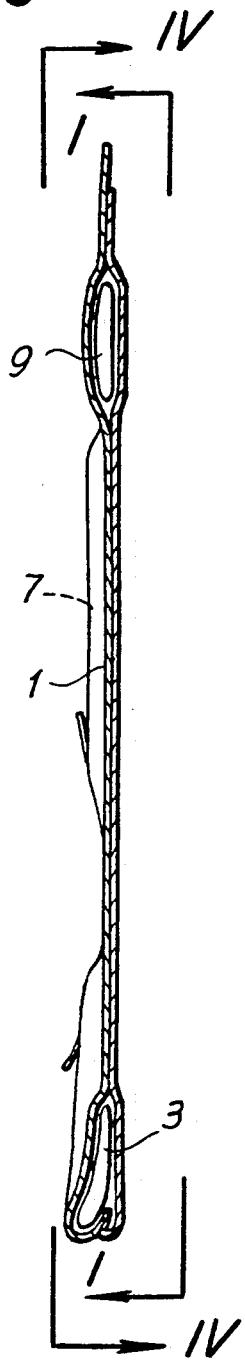
FIGS. 2 and 3 show cross-sections according to II—II and III—III of FIG. 1.

According to a practical embodiment illustrated in FIGS. 1 to 4, a tubular sole 1 has been produced from very fine leather or an equivalent material and includes the cavities 3, 5, 7, 9, the walls of which are made of elastic rubber and which are located (see the drawing) in the region of the heel, along the inner and outer arches and across the first metatarsus; the various cavities are filled independent of one another, there nevertheless being the possibility of making them interdependent, with a spherical granular material of approximately 0.10/0.15 mm, up to the degree of filling which makes it possible to obtain the form recommended for the orthopedic correction required by the doctor. These cavities filled in this way perform a bearing function, and their intrinsic properties act on the foot without traumatizing it. They fit perfectly between the sole of the foot and the shoe both in the static position and in the dynamic position, because of the movability of the granular content and the elastic bending of the walls of the cavities.

The elasticity of the walls of the cavities and, more particularly, the sliding of the filling material consisting of spherical granules provide resilience and recovery after temporary deformation caused by the load at the moment of greatest tension, absorbing the knocks and thus stimulating the anatomical physiology of the sole of the human foot. In fact, under the sole of the foot, humans possess, in addition to the connective tissues, ligaments, derm and the like, as a support for the bone structure, adipose pads which, in addition to having characteristics biotypical of age and state of nutrition, form a layer of extremely uniform subcutaneous panniculus adiposus retained by the elastic collagen fibers of the capsules at a certain tension, thus allowing them to execute a limited movement, without coming out of their receptacle. These adipose pads protect the plantar arch and the entire structure of the skeleton of the foot against shocks and allow walking without pain.

The plantar support according to this invention, by imitating this physiology, simulates the function of the pads; the rubber cavities filled with spherical granules can be compared with the cavities filled with fatty tissue, which transmit the stimulations to the plantar aponeurosis exciting and protecting the function, as can be seen in nature, thus preventing the irritations of the tissues surmounting them.

For filling the cavities, such as 3, 5, 7, 9, it is possible to use a syringe needle which is made to penetrate through the elastic wall, thus introducing the granular material in a quantity easily proportionable and variable as a result of the succession of injections. The elastic walls (made of para-rubber or the like) are, by their very nature, capable of reclosing the hole made by the needle. However, the possibility of using easily removable adhesives must also not be excluded.

A cavity, such as, for example, the cavity 3 of the heel, is subdivided into two parts: an inner part and an outer part for allowing a necessary correction of the rear of the foot. At all events, the movability of this material is less than that of a liquid. The granular material can consist, for example, of small spheres of polymethyl/methacrylate or of any other equivalent material. Alternatively, although not preferably, a viscous liquid can be used as the filling material.

Figure 1:
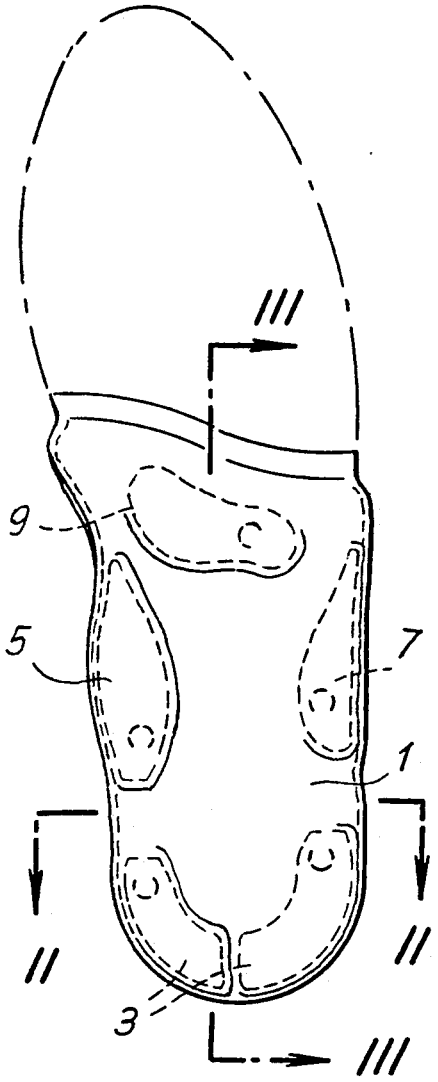
FIG. 1 is a front view according to I—I of FIG. 3.
Figure 4:
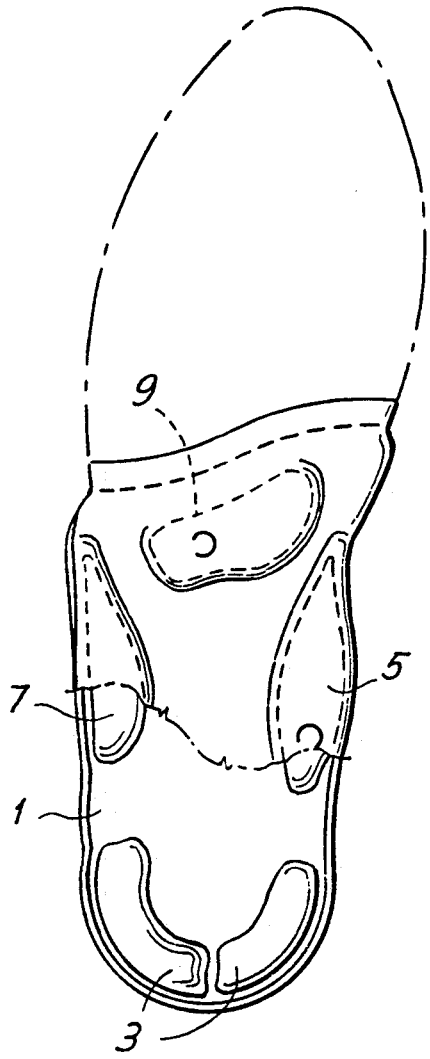
FIG. 4 is a view according to IV—IV of FIG. 3.
Figure 2:
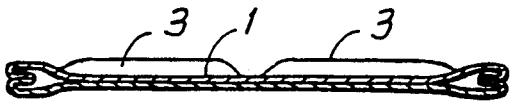

The sole of FIG. 1 can be fastened to the shoe by means of an adhesive (for example, VELCRO) or incorporated in it (particularly in sports shoes) during production, to allow individual correction, obtain the best muscular performance of the athlete at the time of the sporting endeavour, but also reduce his fatigue.

Figure 5:
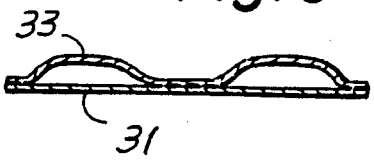
FIG. 5 shows an alternative embodiment.

FIG. 5 shows an alternative embodiment, in which the cavities are formed by two lamellae (31 and 33) arranged so as to define the cavities; one of the lamellae (31) forms the sole and the other can be continuous or zonal and thus form the cavities.

Figure 6:
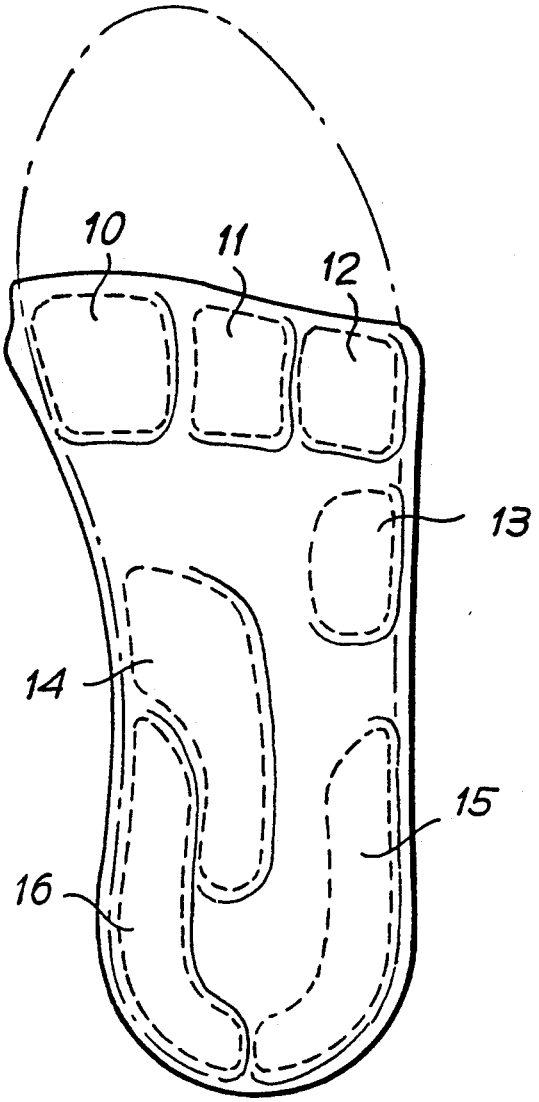
FIG. 6 shows another embodiment of a corrective plantar support.

In FIG. 6, the plantar support has seven cavities intended for stimulating the propioceptive system of the sole of the foot. Plantar muscles, on which action is to be taken, correspond to each cavity. Thus, the cavity 10 acts on the short and long flexors of the big toe, the cavity 11 influences the adductor of the big toe and the levator of the 2nd and 3rd metatarsi, whilst the cavity 12 influences the opponens of the 5the toe. The cavity 13 acts on the flexors of the 5the toe. The cavity 14 influences the adductor of the big toe. The cavity 15 serves as a support and for correcting supination. Finally, the cavity 16 serves as a support for and for correcting pronation. This embodiment is intended more particularly for orthopedic correction, for example for the following indications: flat foot, hammer toe, hallux valgus, instability of the heel, pronation or supination of the heel, falling of the anterior arch, vertebral and paravertebral pains, secondary imbalance of the knee, sacroiliac pains.

Figure 7:
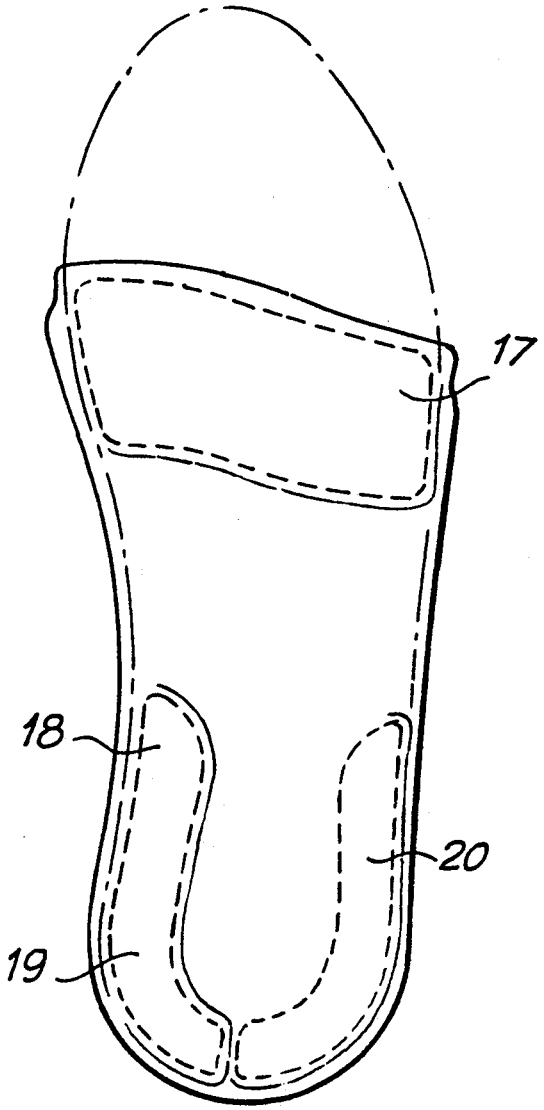
FIG. 7 shows yet another alternative embodiment of a corrective plantar support.

The plantar support of FIG. 7 has three cavities. A radial front cavity 17 serves as a retrocapital bar balancing the support of the anterior arch and metatarsi. At the heel and in that part of the sole of the foot turned inwards, the cavity 18, 19 with its front part 18 stimulates the adductor of the big toe and with its rear part 19 supports and corrects pronation. Finally, the cavity 20 serves as a support for and for correcting supination. This embodiment intended particularly for orthopedic correction is indicated, for example, for the following: instability of the heel, pronation or supination of the heel, falling of the anterior arch, vertebral and paravertebral pains, secondary imbalance of the knee, sacroiliac pains.

The plantar support of this invention makes it possible to carry out variable individual corrections, the form of which can be made suitable for orthopedic purposes and for prevention and is capable of successive adjustments.

This support offers dynamic self-adjustment and a return to the inner pressure equilibrium, assisted by the elasticity of the cavities and by the inner movement of the spherical granules.

Access to the elastic cavities can be gained via valves which make it possible to fill them or empty them interdependently, in order to maintain or correct the supports during use gradually and progressively in successive periods, correcting the faults of the muscular positions and/or of the skeleton in the appropriate proportion.

A sole like that described can also be transferred from one shoe to the other, because it allows the necessary adjustments for recovering the spaces and the pressure, maintaining a constant corrective effect.

The sole also fits heeled shoes, since the material used allows it to match the curves imposed on the foot by the shoes and correct the load changes attributable to the abnormal positions of the trochleoastragalic and metatarsal joints.

This sole which makes accurate and adjustable corrections of anomalies makes it possible to reduce and prevent the pain caused by the defective positions of the spinal column and the sacroiliac joint caused by unrecognized walking faults.

The sole, whilst correcting walking in a sophisticated way, reduces the uneven wear of the shoes.

It is clear that the drawing gives only a practical example illustrating the invention which can vary in terms of its forms and the location of the cavities, without going beyond the limits of its concept.

I claim:

1. A plantar support for use in a shoe comprising a unitary body including a plurality of cavities having elastically flexible walls and joined by a flat web, the cavities being sealed off from each other and containing dry, mobile fillings of granular material defining discrete, resiliently deformable, raised pads spaced apart by flat, unfilled, foot engaging portions of the web, the pads being for adjustment of selected spaced apart bearing surfaces of the foot, a wall of each cavity being pierceable by a hollow needle and self-closing so that the filling material can be controllably introduced into or removed from the cavity through the needle to adjust the pad.

2. A plantar support according to claim 1 wherein the walls are included in a tubular sleeve which forms a flexible sole and which can be removable secured in the shoe by releasable attachment means.

3. A plantar support according to claim 1, wherein the cavities are permanently formed with the shoe sole during manufacture of the shoe.

4. A plantar support according to claim 1 in which the body comprises first and second lamellae located in face-to-face relation, the first lamella forming a sole and the second lamella being attached thereto at preselected locations providing enclosed zones, spaced apart across the web, in which the lamellae overlie in spaced apart relation thereby defining the cavities.

5. A plantar support according to claim 1 in which the granular material comprises particles of between 0.10–0.15 mm diameter.

6. A plantar support comprising first and second flexible lamellae located in face-to-face relation, the first flexible lamella forming a sole and the second lamella being attached thereto at pre-selected locations defining flat, foot engaging areas between spaced apart enclosed zones in which the lamellae overlie in spaced apart relation defining isolated cavities each containing a dry mobile filling of granular material of substantially 0.10–0.15 mm diameter, at least one of the lamella being of flexible, self closing rubber-like material so that the filled cavities provide raised resiliently deformable pads each penetrable by a hollow needle through which the granular material can be controllably introduced into or removed from the cavity to adjust the pad.

* * * * *